US005119572A

United States Patent [19]

Graham

[11] Patent Number: 5,119,572

[45] Date of Patent: Jun. 9, 1992

[54] ADJUSTABLE CRAFTER'S STAND

[76] Inventor: Jewel P. Graham, R. R. 1, Box 273, Hawkins, Tex. 75765

[21] Appl. No.: 525,911

[22] Filed: May 21, 1990

[51] Int. Cl.[5] ..... D05C 1/02

[52] U.S. Cl. ..... 38/102.2; 108/6

[58] Field of Search ..... 38/102, 102.2; 223/120; 248/122, 127, 140, 158, 371, 413, 419, 421; 108/1, 4, 6; 160/380; 403/262

[56] References Cited

U.S. PATENT DOCUMENTS

| | | | |
|---|---|---|---|
| 437,240 | 9/1890 | Przewdzink | 38/102.2 |
| 1,357,737 | 11/1920 | Solaini | 38/102.2 |
| 1,845,868 | 2/1932 | Eriksen | 108/4 |
| 2,464,690 | 3/1949 | Ketchem | 108/4 X |
| 2,567,593 | 9/1951 | Bemis | 108/4 |
| 3,309,803 | 3/1967 | Wilson | 38/102.2 |
| 3,641,946 | 2/1972 | Charnay | 108/6 |
| 3,750,312 | 8/1973 | Bucher | 38/102.2 |
| 3,855,718 | 12/1974 | Parsons et al. | 38/102.2 |
| 4,350,098 | 9/1982 | Shirono et al. | 108/6 |
| 4,469,029 | 9/1984 | Ramond | 108/3 |
| 4,549,366 | 10/1985 | Gerding et al. | 38/102.2 |
| 4,590,695 | 5/1986 | McGillivray | 38/102.2 |
| 4,660,814 | 4/1987 | Shader et al. | 38/102.2 X |
| 4,818,135 | 4/1989 | Desjardins | 248/413 X |
| 4,943,040 | 7/1990 | Finstad et al. | 108/6 X |

FOREIGN PATENT DOCUMENTS

| | | | |
|---|---|---|---|
| 0412998 | 3/1946 | Italy | 38/102.2 |
| 0467574 | 12/1951 | Italy | 38/102.2 |
| 0057505 | 8/1912 | Switzerland | 38/102.2 |

*Primary Examiner*—Werner H. Schroeder
*Assistant Examiner*—Ismael Izaguirre

[57] ABSTRACT

A metal stand for supporting fabric materials being used in arts and crafts projects. The stand is adjustable with full 360 degree rotation of the top portion, a tilt angle of 180 degrees, and a vertical height adjustment. The stand has a flat base which supports the middle portion having the adjustment mechanisms which in turn supports the top portion having ledges for supporting an embroidery hoop. The top portion is interchangeable with others to accommodate different sized hoops. The stand was designed so that when the user is seated, the project on the hoop rests on the stand directly in front of the user. the adjustments for height, tilt, and rotation are manually set, and the mechanisms are simple and re-adjust easily.

1 Claim, 3 Drawing Sheets

ADJUSTABLE CRAFTER'S STAND

BACKGROUND OF THE INVENTION

This invention relates to adjustable stands, and more particularly adjustable stands for supporting fabric material, in a hoop, for arts and crafts projects.

DESCRIPTION OF PRIOR ART

The arts and crafts field needs devices to support material being used. These projects require long hours of sitting and the material has to be kept stretched tight. Most of these materials are placed in a hoop or frame to accomplish the project. Problems with these projects include: space needed for support devices such as quilting frames; support devices to hold project material to allow users' hands to be free; long hours of work on these projects need comfortable work areas; and this field needs support devices that are durable and easy to use. These problems have been addressed by some adjustable support devices with elaborately designed stands. However, these have many parts, are complicated to the user, and expensive for the average user. Support devices in this field will always be a matter of choice for the user to decide which is best for their own project. Solving the problems of space, adjustments for comfort, and durability for the most part, the simple, easy to use adjustable stand is sought.

SUMMARY OF THE INVENTION

The market of adjustable stands for arts and crafts fabric material projects is in the process of developing. The market for a long time relied on methods and frames used long ago. While these still worked for certain projects, new ones have evolved which need different means to accomplish these new projects. Some of the adjustable stands address the problems the users has today, however many are essentially of very complicated construction and others are wooden stands and not durable in service.

An object of this invention is to provide a device that is durable and sturdy, which addressed the problems encountered in fabric material arts and crafts projects of space, adjusts for comfort of user, and allows freedom to the hands of the user.

A further object of this invention is to provide an adjustable stand that supports heavy weighted fabrics as easily as the light weighted fabrics with sufficient balance so the stand will not be top heavy and tip over easily.

The concept of an adjustable stand is not new, the design and construction which accomplishes these goals is very simple and efficient for its intended purpose. The simplicity of this invention will be more fully understood by reference to the drawings and description included herewith.

BRIEF DESCRIPTION OF DRAWINGS

In the drawings designated parts are referenced with corresponding characters, in the specification, throughout the view.

DESCRIPTION OF THE PREFERRED EMBODIMENT

Figure 3:
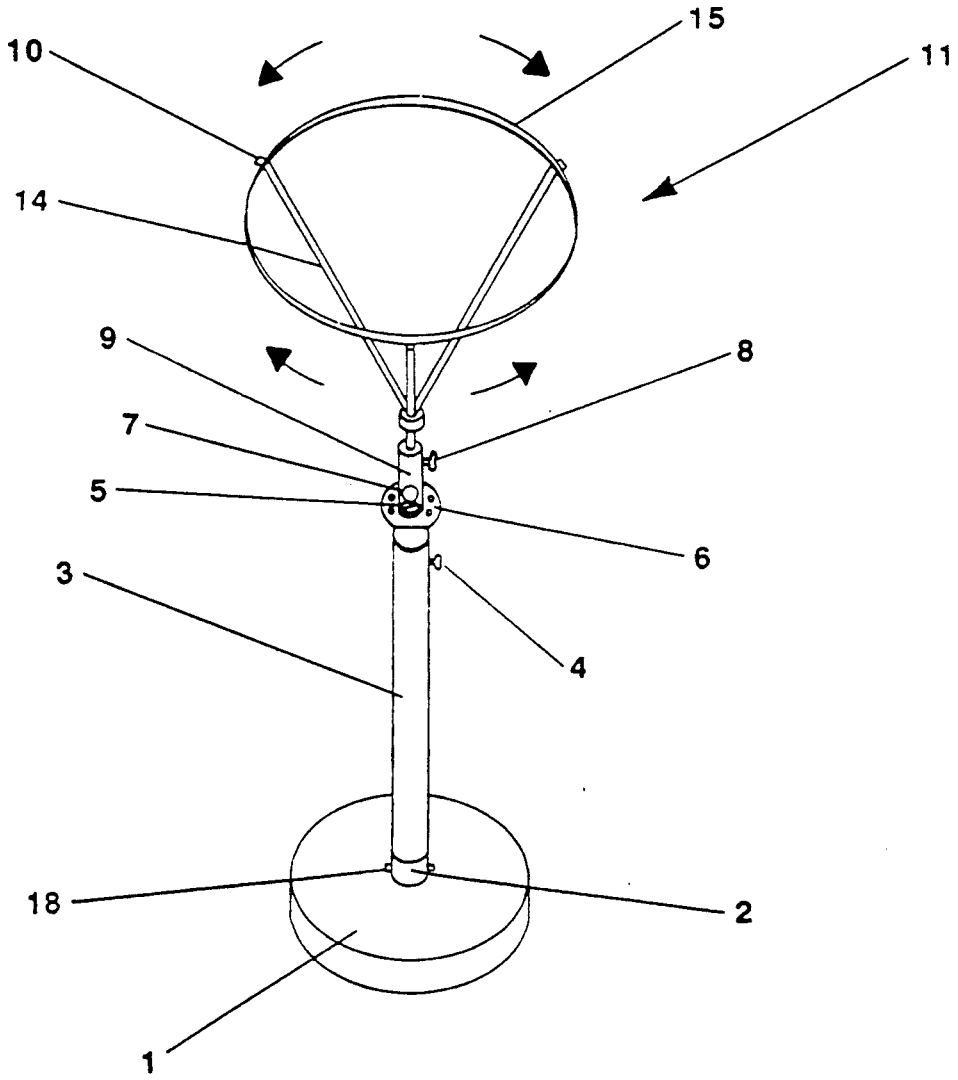
FIG. 3 is a fully assembled side view of the invention showing directional movement of the top portion thereof.

Referring to the figures, an adjustable metal stand for supporting fabric materials of arts and crafts projects placed in a wooden hoop, is shown in FIG. 3. A top portion of this device is called the Head, 11. The Head has three brace members 14, with a small ledge 10 at the top end of each extending perpendicularly outward to a circular rim 15. The Head rotates in a circular motion clockwise or counter clockwise as shown by arrows in FIG. 3. The Head 11 fits into the top of a a middle portion consisting of a tilt mechanism 9, and is held in place by a thumb screw lock 8.

Figure 1:
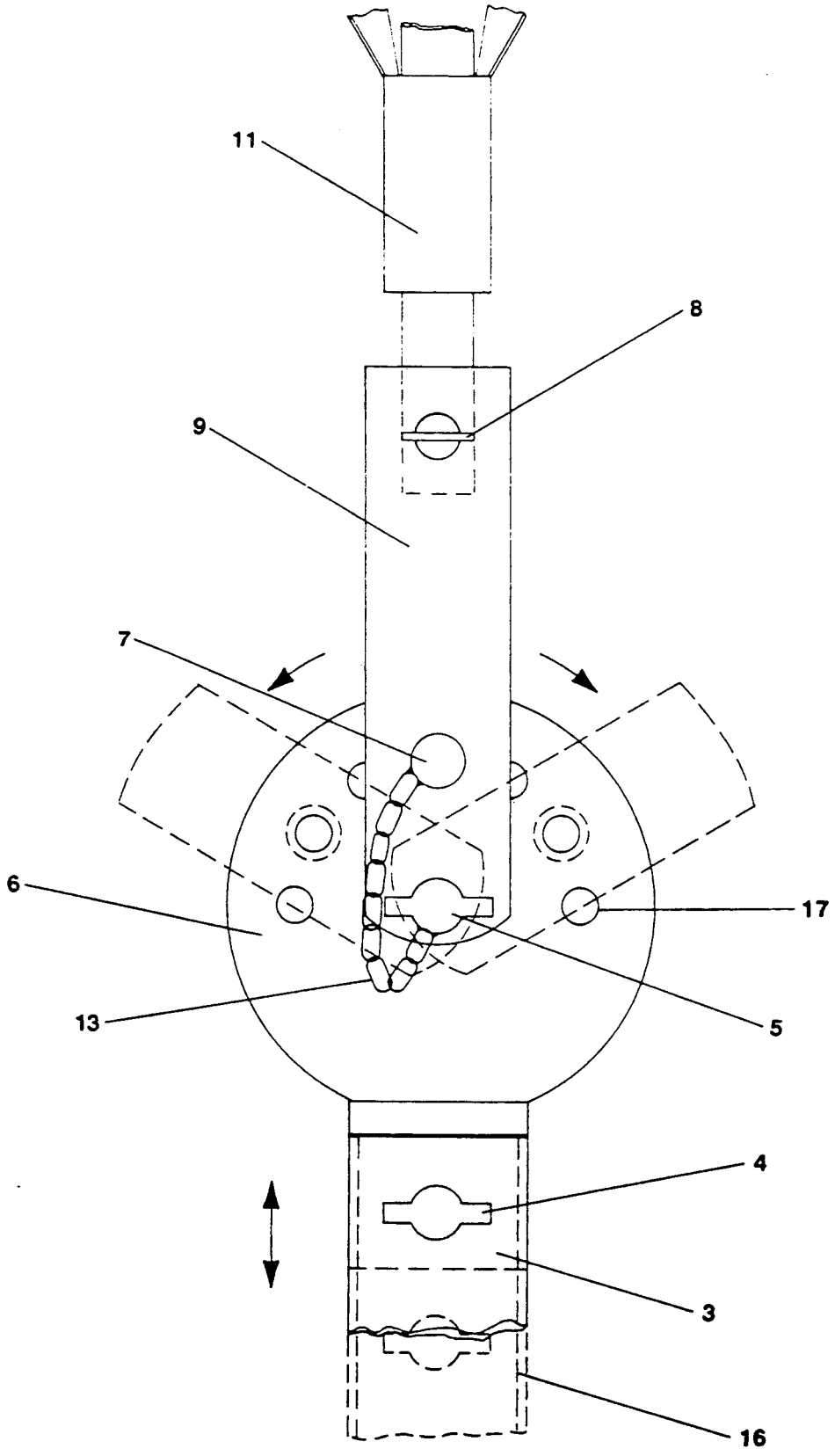
FIG. 1 is an enlarged side view of the tilting portion assembly in relation to other portions of the invention with directional movement in this portion.
Figure 2:
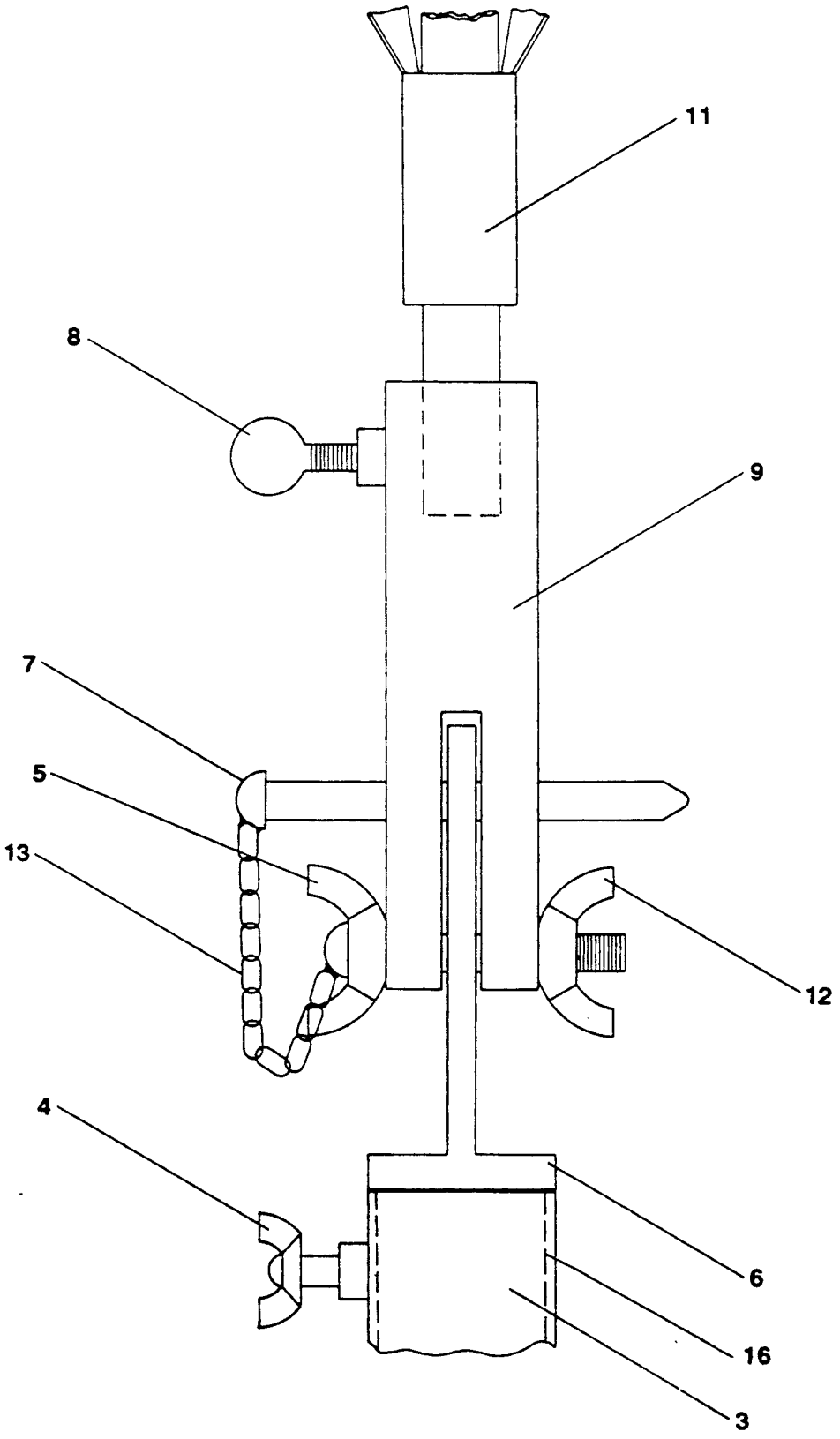
FIG. 2 is an enlarged frontal view of the assembled tilting portion of the invention.

The Tilt mechanism also shown in FIGS. 1 and 2 is a shaft 9 that has been drilled out at the top, sliced up at its center bottom, with holes drilled to attach a hinge mechanism 5,7,12. A circular plate 6 is attached to a tubular pipe 16 shown in hidden lines in FIG. 1 and 2 within pipe 3 for allowing height adjustment thumb screw 4 to lock the Head 11 in the desired height. The shaft 9 of the tilt mechanism moves forward and backward along plate 6 as shown by the arrows in FIG. 2 while the height adjustment moves up or down as shown by the vertical arrows. The tilt angle of this device is manually controlled by the user making simple adjustments of the Pin insert 7. Height adjustments are made by pulling up or down at 11 after loosening wing nut lock 4 and hand tightening again when the desired position is reached.

The base or bottom portion shown in FIG. 3 consists of a metal plate 1 with a metal plate circular band 2. The metal 1 has a small tubular shaft in the center (not shown) that has a tubular pipe 3 attached with a bolt and screw 18 and extending upward from the base. The tubular pipe 16 of the height adjustment slides easily inside the tubular pipe 3 of the base. The base holds the upper portion of the device in a manner to allow varying weighted fabrics to be used without the stand tipping over very easily.

The stand is loaded with the project with the insert pin 7 holding the Head in an upright position. The loaded Head is then positioned for desired tilt angle by repositioning the insert pin in holes 17 of FIG. 1. The Head will rotate clockwise or counter clockwise or remain stationary by adjusting the thumb screw lock 8. These adjustments are manually controlled by the user. The user generally would set the height adjustment setting the level at which the user will be working on the fabric material project. Thus, the user is ready to work on the project.

The Head of the device is interchangeable with heads of other sizes so as to accommodate the size of arts and crafts fabric material projects which are of various sizes. The variation in size correlates with the size of the wood hoop used to keep the project material stretched tight while the user works on the project. A different size wooden hoop, loaded with project material fits down over the rim of a different size Head resting on the small ledges 10. The other portions of the invention are now adjusted in the same manner as previously described.

LIST OF PART REFERENCE NUMERALS

1 Metal base

2 Short shaft with bolt and screw
3 Tubular pipe of base-tubular pipe of height adjustment inside
4 Wing nut lock for height adjustment
5 Thumb screw and nut hinge mechanism-small chain attached
6 Circular plate-hinge hole in the center and holes along outer edge for tilt angle
7 Pin insert for holding selected angle of Tilt-small chain attached
8 Thumb screw lock for head
9 Metal shaft drilled hole at top holds Head-Slice from the center bottom forms Tilt mechanism that fits over and attaches to the circular plate (numeral 6) and hole drilled thru side for hinge mechanism (numeral 5)
10 Small ledges of Head-three on each Head-wooden hoop rests on these small ledges
11 Circular rim of Head attached to shaft of Head with three braces, shaft of Head is made smaller at the bottom end to fit into the drilled hole in top of the Tilt Shaft
12 Wing nut of hinge mechanism
13 Small chain connected at both ends-one the end of the head on the Pin Insert and the other end attached to the head of the hinge screw
14 Brace members-welded to rim-three braces on each Head
15 Circular Rim of Head
16 Tubular pipe of Base inside tubular pipe of Tilt base
17 Holes for Pin Insert-used for setting adjustment of angle of Tilt
18 Bolt and Screw

What I claim is:

1. An adjustable embroidery stand comprising:

(a) a top portion having at least one interchangeable head having a circular rim and ledges projecting perpendicularly from said rim, for supporting an embroidery hoop with fabric material thereon, said at least one interchangeable head being interchangeable with a plurality of interchangeable heads of varying sizes to accommodate a respective size of hoop;

(b) a middle portion supporting said top portion including first adjusting means for selectively rotating said top portion clockwise or counter clockwise, and second adjusting means for selectively angling said top portion, and third adjusting means for raising or lowering said top portion;

(c) a bottom portion supporting said middle portion including a flat base and a tubular member connected to and extending vertically from said base.

* * * * *